United States Patent [19]

Takechi et al.

[11] 4,046,597

[45] Sept. 6, 1977

[54] VIBRATION DAMPING STEEL MATERIAL AND PROCESS FOR PRODUCING THE SAME

[75] Inventors: Hiroshi Takechi; Mitsunobu Abe; Matsuo Usuda, all of Kisarazu; Kunihiko Komiya, Kimitsu, all of Japan

[73] Assignee: Nippon Steel Corporation, Japan

[21] Appl. No.: 749,082

[22] Filed: Dec. 9, 1976

[51] Int. Cl.[2] ..... C21D 7/14

[52] U.S. Cl. ..... 148/12 R; 148/36; 148/134

[58] Field of Search ..... 148/134, 36, 12 C, 12 F, 148/12 R

[56] References Cited

U.S. PATENT DOCUMENTS

| | | | |
|---|---|---|---|
| 3,331,715 | 10/1959 | Bulina et al. | 148/142 |
| 3,716,420 | 2/1973 | Matsudo et al. | 148/12 C |
| 3,954,516 | 5/1976 | Hu | 148/12 C |

*Primary Examiner*—Arthur J. Steiner

*Attorney, Agent, or Firm*—Wenderoth, Lind & Ponack

[57] ABSTRACT

A vibration damping steel containing C ≦ 0.10% and Mn ≦ 0.40% as the essential constituents and having a lower yield point or 0.2% proof stress of 7-28kg/mm$^2$ with the degree of refinement of the steel being not less than 0.18 while still maintaining the specific gravity at 7.859g/cm$^3$ or less, and a process for producing the same. This steel material is particularly suited for use in items which to produce and transmit vibration and noise.

3 Claims, 1 Drawing Figure

Shock noise testing method
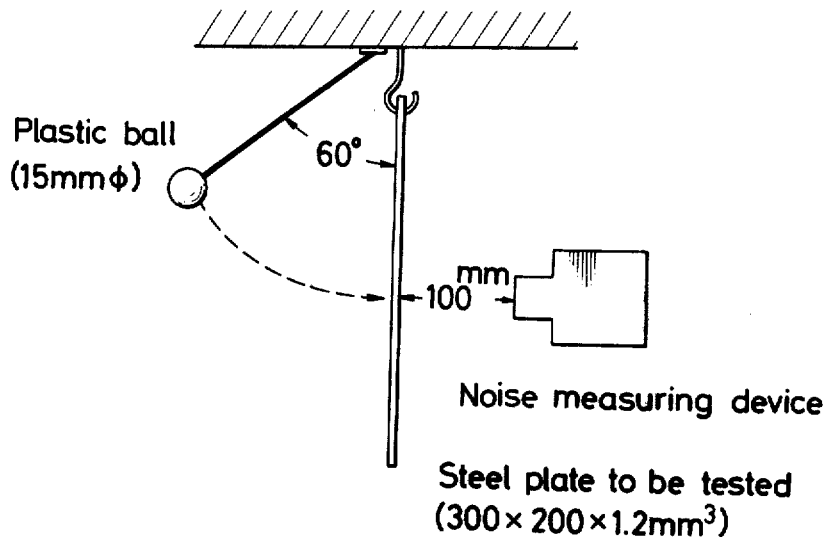

VIBRATION DAMPING STEEL MATERIAL AND PROCESS FOR PRODUCING THE SAME

This invention relates to a vibration damping steel material suitable for use in items which produce and transmit vibrations and noise, for example a cover surrounding a moving power source such as an engine on a railway, automobile, or ship, or a fixed power source in a factory, and further, soundproof walls or panels of power chambers, and further, hoppers, ducts and conveyors, and a process for producing the same.

Recently, traffic facilities, beginning with the Tokaido Shinkansen (Bullet Train) and including cars, and machine plants give rise to a problem of noise pollution, and various legal regulations are being applied. For this purpose, it goes without saying that the development of a material having improved vibration damping characteristics is indispensable. In the case of the traffic facilities, for example, there may be employed glass wool, rubber, plastic and the like as soundproof materials for construction of soundproof walls, and vibration restricting plates for bridges. But, frame structures for these constructional parts will be made up by use of steel plates. If this steel material itself has superior vibration damping characteristics, therefore, the effect of those such as soundproof walls will be further improved. Various steel materials having such vibration damping characteristics are known but all of them are of high alloy steel with addition of large amounts of alloying elements, as for example, disclosed in Japanese patent application Publication No. 42-12350, and therefore are so expensive as not to find general application for such purposes.

With the foregoing in mind, the present invention is directed to imparting into the steel material itself, improved vibration damping characteristics by a relatively cheap method, and has achieved a very important advance in the art.

The feature of the present invention is to provide a vibration damping steel material containing $C \leqq 0.10\%$ and $Mn \leqq 0.40\%$ as the essential constituents and having a lower yield point or 0.2% proof stress of 7–28kg/mm$^2$ with the degree of refinement of the steel as defined in terms of $d = (100 \times N)/(30 \times P)$ being not less than 0.18, wherein when 30 fields for different steel surfaces extracted at random each are to be observed through a microscope at a magnification of 400 times with a glass plate having 20 lattice lines in each of the longitudinal and lateral directions and inserted in a space adjacent an eye-piece of the microscope, P is the total number of lattice points in one field and N is the total number of lattice points occupied by non-metallic inclusions including carbide and summed up over the 30 fields, while still maintaining the specific gravity at a level of not more than 7.859g/cm$^3$ measured based on Archimedes' principle, and to further provide a process for producing the above identified steel material.

The present inventors have conducted investigations on the vibration damping characteristics of various steel materials and found that both the non-metallic inclusions or microscopic vacancies contained in the steel influence the vibration damping effect of the steel material (the effect or reducing vibration when a shock is given to the steel material), and further that this effect is further improved with decrease in the lower yield point or 0.2% proof stress.

The present invention is based on these new findings and has been perfected by further investigations of optimum conditions of non-metallic inclusions, microscopic vacancies in the steel material and the lower yield point (or 0.2% proof stress) thereof in order to insure that the resultant steel material has a superior vibration damping effect to that of the conventional steel materials and further that certain degrees of workability and weldability are preserved.

In the latter connection, it should be explained that steel materials usable in the form of soundproof walls are usually subjected to simple cold working such as bending, and then to welding. It is, therefore, desirable to impart excellent workability and weldability to the steel material. For this purpose, according to the present invention, reduction of workability by solute-hardening is prevented by defining the chemistry of the steel as $C \leqq 0.10\%$ and $Mn \leqq 0.40\%$. Such definition of the compositional ranges leads to prevention of formation of martensite which would otherwise occur when welded zones are rapidly cooled, thus contributing to an improvement in tenacity at the welded zone. Further, when the yield point or yield strength at 0.2 percent proof stress exceeds 28 kg/mm$^2$, not only the cold workability is reduced, but also the vibration damping characteristics is reduced. When this value is below 7 kg/mm$^2$, the strength of the steel material as in the form of items used in construction, such as soundproof walls is not sufficient. Accordingly, the proper range is 7–28 kg/mm$^8$.

The improved vibration damping characteristics in the present invention can be effected by distributing microscopic vacancies within the steel material. Further, the presence of non-metallic inclusions, particularly carbide, is also effective. The amount of microscopic vacancies is evaluated by the specific gravity, and found to be sufficient when the specific gravity measurement based on Archimedes' principle is not more than 7.859 g/cm$^3$. The amount of inclusions including carbides may be evaluated in terms of $d$, and found to be sufficient when the value of $d$ is not less than 0.18. The improvement of the vibration damping characteristics can be achieved as a multiple effect resulting from the individual definitions of the above-mentioned yield point (or yield strength at 0.2% proof stress), amount of vacancies (accordingly specific gravity) and amount of inclusions (accordingly $d$ value).

In producing these steel materials, specific conditions must be applied, and this is also one of the present discoveries. The microscopic vacancies suitable for improvement of the vibration damping characteristics are at first formed in the plastic deformation of the rolling process. However, after this, it becomes necessary to carry out annealing in order to improve the workability and to retain the yield point in the proper range. In this case, if the annealing conditions are not proper, the microscopic vacancies will be filled up by diffusion of Fe atoms. The proper condition of this annealing is as follows. When the annealing temperature is lower than 680° C, the workability cannot be made sufficient, while when above 900° C, the diffusion of Fe is so vigorous as to fill up the vacancies. Therefore, the annealing temperature must fall in a range of 680°–900° C. As for the annealing time, 40 seconds or less will lead to a reduction in workability because of the incomplete recrystallization, while 3 minutes or more is too long for diffusion of Fe so that the vacancies will be filled up. Accordingly, an annealing time ranging from 40 seconds to 3 minutes is optimum. This annealing operation may be performed either after hot rolling operation, or after hot rolling followed by cold rolling operation. It is preferred that the annealing operation be a continuous one.

In an embodiment of the present invention, it is particularly suitable to set forth the following conditions. As for the chemical constituents of the vibration damping steel material, it is preferred that C ≦ 0.015, and Mn ≦ 0.25. It is more preferred for improvement of the workability that C ≦ 0.009 and Mn ≦ 0.20. Further, within the framework, it is preferred for the purpose of increasing the amount of vacancies and the amount of inclusions to add 0.01–0.3% of Ti, and further either 0.01–0.1% of a rare earth (REM) element or elements, or 0.02–0.04 of S. It is preferred for improving the vibration damping characteristics that the value of *d* is not less than 0.25, and more preferably 0.32, and that the specific gravity is not more than 7.850 and more preferably 7.840.

In the production process, when the hot rolling is combined with the annealing, it is preferred that the hot rolling finishing temperature is not more than 850° C and more preferably 680° C, and that the draft is not less than 90%. When the cold rolling is combined with the annealing, it is desirable to coil the hot rolled strip at a temperature not lower than 650° C so as to coagulate and coarsen the precipitates such as carbides and to maintain the cold rolling variation at 60% or more. More particularly at 70% or more for the purpose of increasing the amount of vacancies, it is preferred for the purpose of increasing the amount of vacancies, that the cold rolling draft is not less than 60% and more preferably 75%.

To this vibration damping steel material there may be applied a surface treatment such as a zinc coating without damaging its capabilities. This vibration damping steel material when used in making panels of soundproof walls for railways and roads, railway trains, automobiles and ships contributes to prevention of noise pollution, and moreover when used in liquid transporting tubes, produces similar effects to the above.

EXAMPLE:

A number of steels including a capped steel containing 0.05%C and 0.28%Mn and steels containing 0.005%C, 0.20%Mn, 0.15%Ti and a rare earth element and of which the compositions are shown in Table 1 were made by a converter, then hot rolled at a finishing temperature of 820° C, then cold rolled at a draft of 78% to respective plates of 1.2mm thick, and then annealed under the conditions shown in Table 1. These steel specimens were tested for yield point, specific gravity and *d* value, and further subjected to a shock noise producing test using an apparatus shown in the accompanying drawing wherein the size of each of the specimens is 200×300mm. The results are shown in Table 2.

Specimen No. 3 which is one of the steel materials of the present invention was found to produce noise with 93db(A), while control specimens Nos. 1, 2, 4 and 5 to produce with higher noise by 6–10 db(A). Specimen No. 6 with higher C and Mn contents has a higher yield point so that the noise produced is higher. Specimens Nos. 7 and 8 which are particularly preferred examples of the present invention, show remarkably improved vibration damping characteristics as the noise produced is lowered below 90 db(A).

Table 1

Steel Composition and Annealing Condition

| Steel Specimen No. | Composition | | | | | Annealing Condition | | |
|---|---|---|---|---|---|---|---|---|
| | C | Mn | Ti | REM | S | Temp. (° C) | Time (min.) | |
| 1 | 0.05 | 0.28 | — | — | — | 550 | 20 | Control |
| 2 | " | " | " | " | " | 650 | 1 | " |
| 3 | " | " | " | " | " | 780 | 2 | Present Invention |
| 4 | " | " | " | " | " | 860 | 30 | Control |
| 5 | " | " | " | " | " | 950 | 1 | " |
| 6 | 0.13 | 0.52 | " | " | " | 850 | 2 | " |
| 7 | 0.005 | 0.20 | 0.15 | 0.05 | " | 750 | 2 | Present Invention |
| 8 | 0.005 | 0.20 | 0.15 | — | 0.028 | 850 | 1 | " |

Table 2

Properties of Steel

| Steel Specimen No. | Yield Point (kg/mm²) | d Value | Specific Gravity (g/cm³) | Shock Noise (db(A)) | Remark |
|---|---|---|---|---|---|
| 1 | 38.3 | 0.20 | 7.856 | 103 | Control |
| 2 | 30.5 | 0.25 | 7.855 | 99 | " |
| 3 | 19.7 | 0.23 | 7.853 | 93 | Present Invention |
| 4 | 18.1 | 0.18 | 7.862 | 101 | Control |
| 5 | 16.3 | 0.13 | 7.864 | 102 | " |
| 6 | 33.4 | 0.28 | 7.860 | 105 | " |
| 7 | 10.6 | 0.31 | 7.841 | 89 | Present Invention |
| 8 | 11.3 | 0.38 | 7.833 | 86 | " |

What is claimed is:

1. A vibration damping steel material consisting essentially of C ≦ 0.10% and Mn ≦ 0.40%, said material having a lower yield point or 0.2% proof stress of 7–28 kg/mm² with a *d* value of not less than 0.18 determined by the formula $d = (100 \times N)/(30 \times P)$ wherein when 30 fields for different steel surfaces extracted at random each are observed through a microscope at a magnification of 400 times with a glass plate having 20 lattice lines in each of the longitudinal and lateral directions and inserted in a space adjacent an eyepiece of the microscope, P is the total number of lattice points in one field and N is the total number of lattice points occupied by non-metallic inclusions including carbide and summed up over the 30 fields, while still maintaining the specific gravity at a level of not more than 7.859 g/cm³ measured based on Archimedes' principle, said material produced by a process comprising the steps of forming a slab, billet or bloom, hot rolling and then annealing at a temperature of 680°-900° C for not less than 40 seconds but not more than 3 minutes.

2. The vibration damping steel material of claim 1 produced by a process further comprising cold rolling after hot rolling.

3. A process for producing a vibration damping steel material consisting essentially of C $\leqq$ 0.10% and Mn $\leqq$ 0.40% and having a lower yield point or 0.2% proof stress of 7-28 Kg/mm$^2$ with a $d$ value of not less than 0.18 determined by the formula $d = (100 \times N)/(30 \times P)$ wherein 30 fields for different steel surfaces extracted at random each are observed through a microscope at a magnification of 400 times with a glass plate having 20 lattice lines in each of the longitudinal and lateral directions and inserted in a space adjacent an eyepiece of the microscope, P is the total number of lattice points in one field and N is the total number of lattice points occupied by non-metallic inclusions including carbide and summed up over the 30 fields, while still maintaining the specific gravity at a level of not more than 7.859 g/cm$^3$ measured based on Archimedes' principle, said process comprising the steps of forming said steel material into a slab, billet or bloom, hot rolling with or without subsequent cold rolling, and then annealing at a temperature of 680°-900° for not less than 40 seconds but not more than 3 minutes.

* * * * *